US005575478A

United States Patent [19]

Lamberti et al.

[11] Patent Number: 5,575,478

[45] Date of Patent: Nov. 19, 1996

[54] GAMING APPARATUS

[75] Inventors: Catherine B. Lamberti, Santa Barbara; Michael O. Cronkite, Thousand Oaks; Roger C. Young, Yorba Linda, all of Calif.

[73] Assignee: Catherine Lamberti, Santa Barbara, Calif.

[21] Appl. No.: 549,626

[22] Filed: Oct. 27, 1995

[51] Int. Cl.[6] ..... A63B 63/00; F41J 5/04

[52] U.S. Cl. ..... 273/372; 273/396; 273/29 A

[58] Field of Search ..... 273/372, 374, 273/371, 396, 29 A, 26 A, 369; D21/199

[56] References Cited

U.S. PATENT DOCUMENTS

| | | | |
|---|---|---|---|
| 2,784,001 | 3/1957 | Simjian | 273/374 |
| 3,729,197 | 4/1973 | Swanson | 273/376 |
| 3,805,030 | 4/1974 | Wichinsky et al. | 273/372 |
| 4,222,564 | 9/1980 | Allen et al. | 273/369 |
| 4,659,090 | 4/1987 | Kustanovich | 273/376 |
| 4,676,511 | 6/1987 | Mackie | 273/376 |
| 5,029,873 | 7/1991 | Davis | 273/376 |
| 5,342,063 | 8/1994 | O'Brien | 273/396 |
| 5,401,033 | 3/1995 | Lychock | 273/372 |
| 5,478,077 | 12/1995 | Miyahara | 273/372 |

*Primary Examiner*—Mark S. Graham
*Attorney, Agent, or Firm*—Jack C. Munro

[57] ABSTRACT

A gaming apparatus which utilizes a wall into which is to be propelled by a human user a ball which is to be rebounded proximate to the user. Formed within the contact surface of the wall are a plurality of hiatuses located in a spaced-apart manner whose function are when struck by the ball to rebound the ball at various directions while still being proximate to the user. Mounted within the wall are a plurality of lenses with there being a light mounted within each lens. Electrically connected to each light is an accelerometer with there being a separate accelerometer mounted on each lens. The accelerometers and lights are electrically connected to a microprocessor which is to be preprogrammed with a particular game that is to be played by the user. The microprocessor is connected to a scoreboard which is to display the results of the game to the user.

1 Claim, 2 Drawing Sheets

GAMING APPARATUS

BACKGROUND OF THE INVENTION

1) Field of the Invention

The field of this invention is directed to games and more particularly, to a game which is to be played by one or more players by propelling a ball against a wall and having that ball return proximate to the player.

2) Description of the Prior Art

Ball sports are in exceedingly common use by humans. Common ball sports are tennis, racquetball, handball, squash, baseball, golf, basketball and soccer. In the playing of certain ball sports, it is normally a requirement to have a partner or opponent in order to return the ball. The ball sports that normally meet this requirement are tennis, racquetball, handball, baseball and soccer. However, when playing tennis, if one wishes to practice by himself or herself, it has been known to utilize a flat board area mounted on a fence. The user then strikes the tennis ball with the racket and propels it into this flat board from which it is to rebound, hopefully proximate to the user to be struck again and propelled again to the board.

The present inventor has in the past made an inventive ball return backboard. A United States design patent has been obtained for this ball return backboard which is formed to be of a basic parabolic shape wherein the contact surface of the ball return backboard includes a plurality of spaced-apart hiatuses which comprise indentations with each indentation formed of a plurality of interconnected planer surfaces. Upon a ball striking the board in the area of the indentation, the ball is to be returned at a slightly different angle than if it just struck a planer wall. That slightly different angle is intended to impart a realistic condition to the user resembling possibly a shot from an opponent that may be located some distance from the user requiring the user to quickly move to that location to return the ball. This parabolic shape of the wall has a tendency to return the ball proximate to the user regardless of where the ball strikes the wall. The wall provides a wide variety of returns so as to keep the player/user in a constant ballready state to respond to every kind of return, be it a forehand, backhand, lob, smash or volley.

SUMMARY OF THE INVENTION

The structure of the present invention is directed to a game which utilizes a ball return wall with this ball return wall being located in a transverse position on a supporting surface. The wall is of a basic parabolic shape so the contact surface of the wall is concave when viewed by the user. Incorporated within the contact surface are a plurality of hiatuses in the form of a sunrise pattern of gentle indentations which each indentation having a plurality of interconnected planer surfaces. Also mounted within the wall are a plurality of sensors in the form of lenses which are located in a spaced-apart manner within the wall. Each lens includes a light and an accelerometer. The light and accelerometer of each lens are electrically connected to a microprocessor. Each lens is surrounded by its own specific area with each specific are being separated from other specific areas by isolation zones formed within the wall. The microprocessor is connected to a scoreboard, a remote control unit, a card reader and a day-for-pay unit. A game type card is to be inserted in conjunction with the card reader which preprograms the microprocessor to "keep score" according to the particular game that is being played by the user with this score to be displayed on the scoreboard to be observed by the user.

One of the primary objectives of the present invention is to incorporate the fun, thrill and excitement of computer games into a ball rebound wall game which will permit a player/user to simulate actual game conditions with or without a partner or opponent.

Another objective of the present invention is to utilize a ball return wall type of game where the skill level of the game can be varied so as to provide games for the beginning player, intermediate player, advanced player and professional player.

Another objective of the present invention is that the playing area required can be as small as 20 feet by 30 feet, with the ideal playing area being 30 feet by 40 feet.

Another objective of the present invention is to provide for simplified installation which requires only two people in under four hours of time.

Another objective of the present invention is to provide a ball return wall gaming apparatus which is ideal for private home use, competitive club play, professional training and resort tournament for the game of tennis.

DETAILED DESCRIPTION OF THE PREFERRED EMBODIMENT

Figure 1:
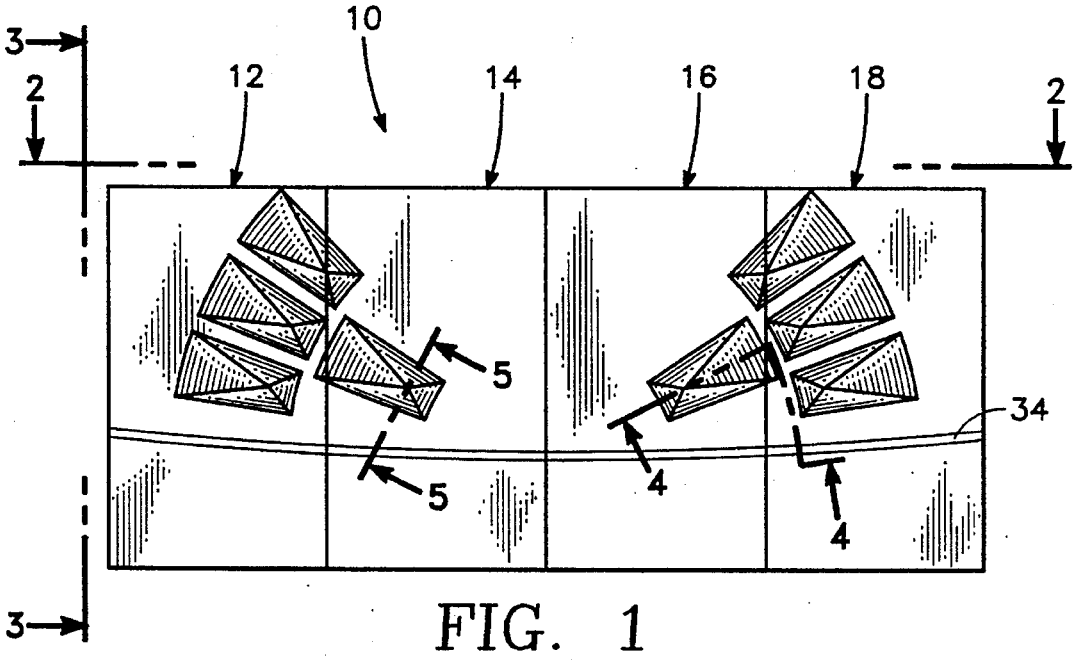
FIG. 1 is a front view showing the contact surface of the rebound wall of the gaming apparatus of the present invention.
Figure 2:
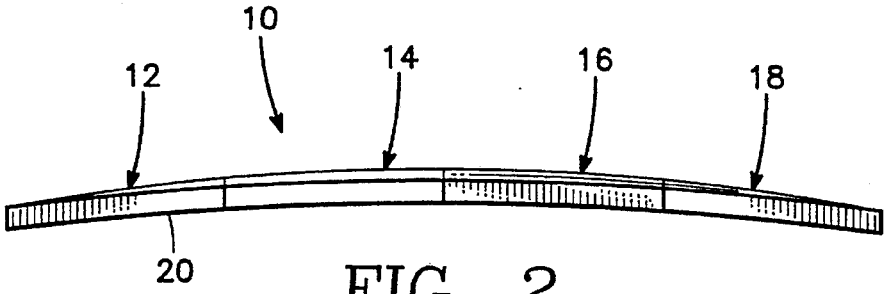
FIG. 2 is a top plan view of the rebound wall of the gaming apparatus of the present invention taken along line 2—2 of FIG. 1.
Figure 3:
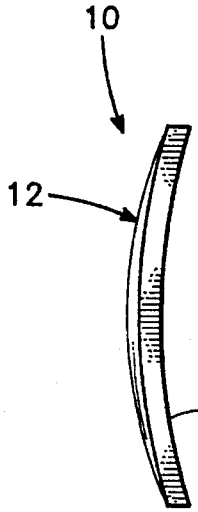
FIG. 3 is a left side view of the rebound wall of the gaming apparatus of the present invention taken along line 3—3 of FIG. 1.
Figure 4:
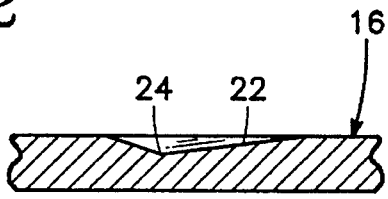
FIG. 4 is a longitudinal cross-sectional view taken through one of the indentations formed within the contact surface of the rebound wall of the present invention taken along line 4—4 of FIG. 1.
Figure 5:
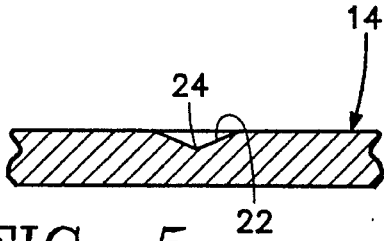
FIG. 5 is a transverse cross-sectional view taken through one of the indentations formed within the contact surface of the rebound wall of the gaming apparatus of the present invention.
Figure 6:
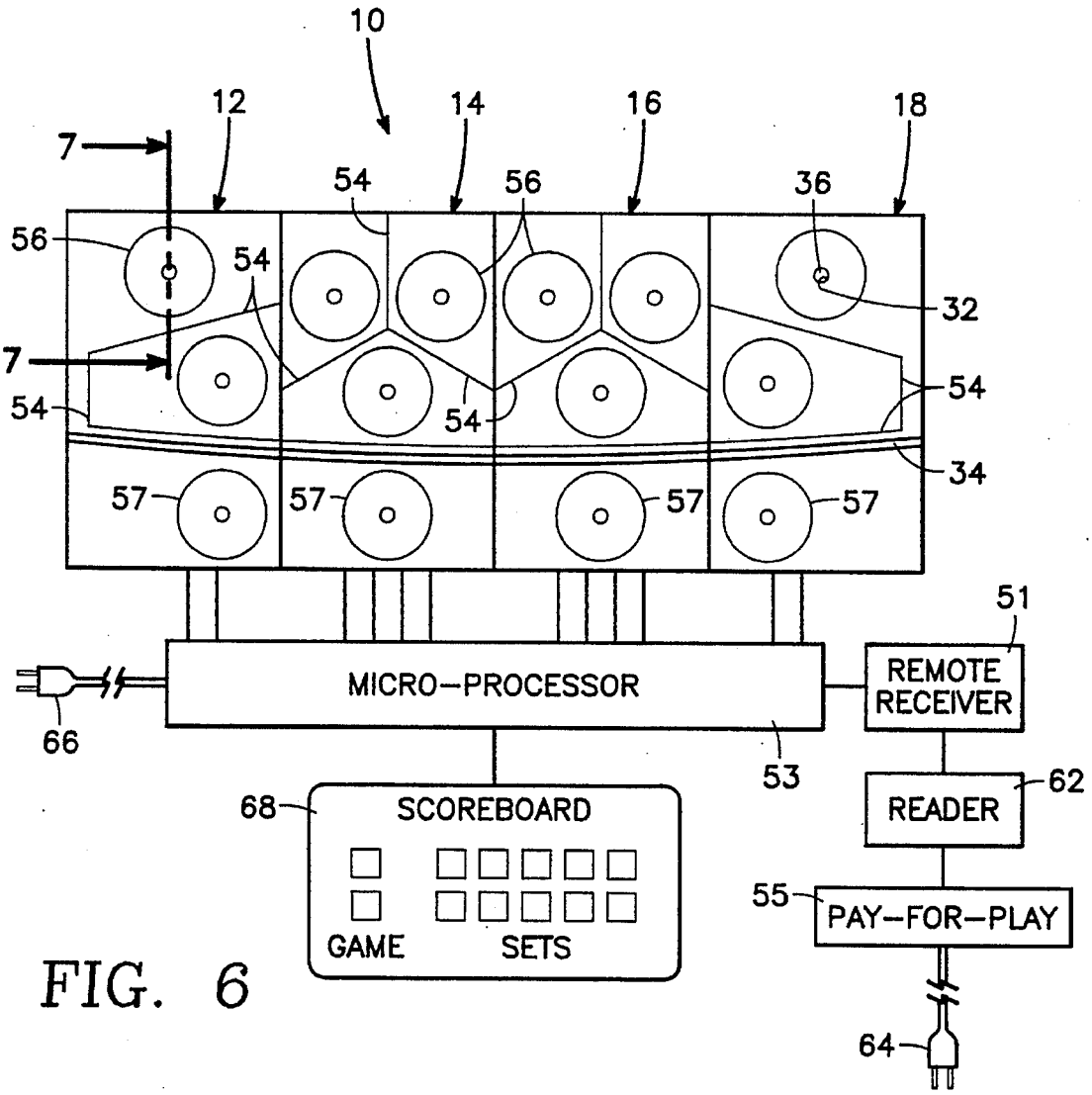
FIG. 6 is a schematic view showing the arrangement of the sensors mounted within the wall and their connection to a microprocessor reader and scoreboard.
Figure 7:
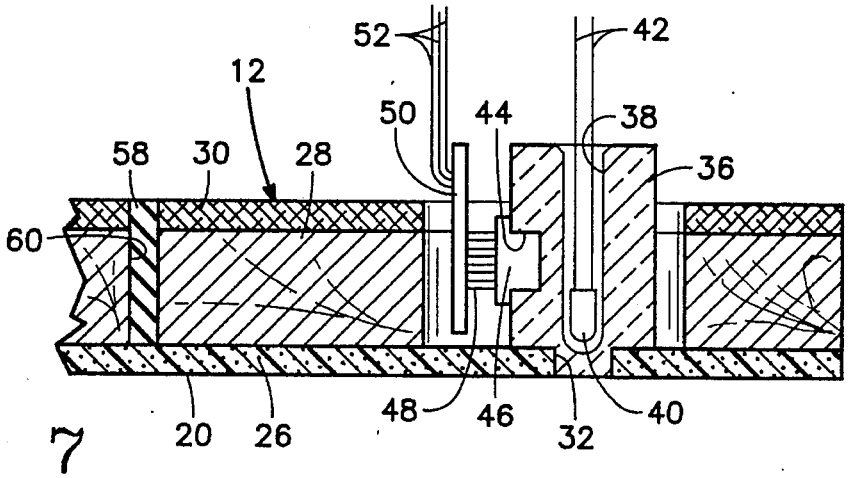
FIG. 7 is a cross-sectional view taken along line 7—7 of FIG. 6 showing in more detail the construction of the rebound wall and the construction of a sensor mounted within the wall.

Referring particularly to the drawings, there is shown in FIG. 1 the rebound wall 10 included within the gaming apparatus of this invention. The rebound wall 10 is constructed of panels 12, 14, 16 and 18. The panels 12, 14, 16 and 18 are of the same size and basically have the same curvature. The front surface of the panels 12, 14, 16 and 18 form a contact surface which is basically concave. The contact surface 20 is actually parabolic. The panels 14 and 16 are basically mirror images of each other, as well as panels 12 and 18.

Formed within the contact surface 20 are a plurality of indentations 22. Each indentation 22 includes four in number of planer surfaces which all join together at the deepest point 24. A ball, such as a tennis ball, is to be capable of striking the indentation 22 and depending upon which planer surface within the indentation 22 that the ball strikes, is rebounded away from the wall 10 at an angle which is slightly different than if the ball would strike the smooth part of the contact surface 20. The reason for the contact surface 20 to be parabolic is so that generally the ball will be rebounded in the direction of the user.

It is to be understood that the gaming apparatus of this invention is a particular utility in conjunction with the game of tennis. However, it is considered that the scope of this invention that the gaming apparatus could be used in conjunction with other ball games such as racquetball, soccer and the like.

It is also considered to be within the scope of this invention that the arrangement of the indentations 22 can be varied employing a different spacing arrangement or the number of the indentations 22 could be increased or decreased without departing from the scope of this invention. It is also considered to be within the scope of this invention that a wall 10 could be utilized that does not include any indentations 22.

It is also to be understood that the wall 10 of this invention is to be mounted by appropriate mounting means (not shown) so that the basic configuration of the wall is in a transverse position on a supporting surface (not shown). This will in essence locate the contact surface 20 in an almost perpendicular position relative to the supporting surface.

Each of the panels 12 are to be constructed in the same manner. Typical construction would be for the contact surface 20 to be composed of a combination of fiberglass reinforced gypsum and fiberglass reinforced epoxy layer 26. The center core of each of the panels 12, 14, 16 and 18 will normally be of a wood construction such as a balsa wood 28. The back surface of the panels 12, 14, 16 and 18 will normally each comprise fiberglass reinforced epoxy layer 30. It is to be understood that the panels 12, 14, 16 and 18 are to be joined together by appropriate joining means (not shown).

Formed within the panels 12, 14, 16 and 18 are a plurality of holes 32. These holes 32 are located in a spaced-apart manner with there being three in number of the holes 32 in the panel 12, four in number of the holes 32 located within panels 14 and 16 and three in number of the holes 32 located within panel 18. Inscribed on the contact surface 20 across each of the panels 12, 14, 16 and 18 is a line 34. The line 34 is located at a height of 37½ inches from the bottom edge of the panels 12 and 18 at the respective outer edges of these panels. At the center of the wall 10, the top edge of the line 34 is at a height of about 36 inches. This line 34 is essentially to duplicate the tape of a conventional tennis net on a tennis court. Therefore, it is intended that when propelling a ball into the wall 10 that the ball should strike the wall 10 above the line 34 and if it contacts the wall 10 below the line 34, that ball would be considered a dead ball in the playing of the real game of tennis. Therefore, when practicing using the wall 10 of this invention, it would be desirable to always hit the ball above the line 34.

Mounted within each of the holes 32 is a lens 36. The lens 36 will normally be constructed of a transparent or translucent colored material and is to be fixedly mounted within each hole 32. It is to be understood that there will be a separate lens 36 for each hole 32. The lens 36 includes an elongated center recess 38 which is open only at the back end of the lens 36. Within the elongated center recess 38 there is to be located a light bulb 40. The light bulb 40 has wires 42 extending therefrom.

Also mounted within a recess 44 formed in the sidewall of the lens 36 is an accelerometer 46. Each accelerometer may be a resonant beam, voice, coil, or solid state monolithic. Connecting with the accelerometer 46 are a plurality of contacts 48. These contacts 48 are electrically connected to a printed circuit board 50. The printed circuit board 50 has extending therefrom a plurality of wires 52. The wires 42 are individually connected to a microprocessor 53. In a similar manner the wires 52 from each accelerometer are also connected to the microprocessor 53. The microprocessor 53 is deemed to be a conventional piece of electronic equipment that is designed to operate the light bulbs 40, as well as receive information from the accelerometer 46.

Each of the panels 12, 14, 16 and 18 include a series of lines 54. The lines 54 are located between directly adjacent specific areas 56. Each specific area 56 concentrically surrounds a hole 32. Each specific area 56 is segregated from directly adjacent specific areas 56 by isolation zones which are formed within each of the panels 12, 14, 16 and 18. These isolation zones coincide with the lines 54. Each isolation zone is formed of a strip of rubber 58 which is poured in a groove 60, then hardened to a solid, coinciding with the lines 54. The grooves 60 are formed within the back surface of each of the panels 12, 14, 16 and 18 and extend in depth to the layer 26. It is the function of the isolation zones defined by rubber material 58 to in essence segregate specific areas 56 from each other. Therefore, when a ball strikes a given specific area 56 or in close proximity thereto, the bulk of the shock is transmitted to its respective accelerometer 46. Only a minor amount of shock will be transmitted to adjoining accelerometers. Using the force differential between accelerometers, as well as the time of transmission of the force, which can ascertained within the programming of the microprocessor, this information can be used in the development of certain games within the microprocessor 53.

There are specific areas 57 located below line 34 which are similar to areas 56 except each area 57 does not include a light bulb 40. The reason for this is that it is not desired to accentuate to the user that a "bad shot" has been made.

Electrically connected with the microprocessor 53 is a card reader 62. The card reader 62 is connected to a conventional source of electricity by means of a plug 64. In a similar manner the microprocessor is connected to a conventional source of electricity by means of a plug 66. Also, a scoreboard 68 is electrically connected with the microprocessor 53, Also connected to the microprocessor 53 is a remote control reviewer 51 which is to be activated by a remote control transmitter (not shown) which is carried by the user. The function of the remote control receiver 51 is to enable the player to select a particular game and level of play on the field of play. Between the reader 62 and 64 is located a pay-for-play unit 55. The pay-for-play unit 55 requires the insertion of monetary currency, credit card or hotel key to activate the microprocessor 53.

The card reader 62 is to be capable of receiving any one of a multitude of cards. Each card is to designate a particular type of game. Insertion of the card within the reader 62 and/or the selection from the remote control receiver 51 will program the microprocessor 53 for that particular type of game. Playing of that particular type of game on the wall 10 will result in displaying of a certain score on a scoreboard 68.

For example, one particular type of game would be by use of a single player and can be called "Up Against the Wall". This game would actually utilize two in number scoreboards 68 with one being used as a time clock and the other scoreboard 68 being used as an incremental scorekeeper. The player would press a button (not shown) on the remote control transmitter (not shown) to select the duration of the gamethirty seconds, sixty seconds or ninety seconds. The player would hit a reset button (not shown) which would reset the time scoreboard to zero and the second scoreboard would display the second time of the game and start counting down. Continuous play requires a hit to the wall every five seconds (or ten seconds, fifteen seconds, etc. depending on the skill level selected) or the game will end. Balls striking the wall above the line 34 will accrue one point per hit while balls striking below the white line will decrease the player's score by one point. When a certain number of points have been earned, such as ten points, all of the lights 40 will be illuminated and an audible tune might possibly be played. The object of this game is to accrue as many positive points within the player's selected game time. When playing of this game, the player may use more than one tennis ball. If per chance the ball is missed and goes out of bounds from the playing area, another ball is to be put into play.

Another example in playing of the game using the wall 10 would be what is termed "Racquet Wall". This game uses two players. The two players are each to utilize a separate scoreboard 68. The players will share the one card (not shown) which is connectable with the reader 62 to select the total number of game points to win, such as 21 points. A player hits the reset button (not shown) on the microprocessor 53 with the first player commencing play with a serve to the wall which must be returned by the second player. The ball must be played alternately between the two players. Each time the ball would strike the wall 10 above the line 34, that particular player would receive one positive point and if the ball is struck below the line 34, the player would receive one negative point. When the selected number of points have been reached by a particular player, all twelve in number of the lights 40 would be illuminated and possibly a victory tune would be played when sound was available.

It is actually to be considered within the scope of this invention that there could be as many as fifty different games that could be read by the reader 62 and that could be preprogrammed within the microprocessor 53. The constructing of the microprocessor 53 is deemed to be conventional by any programmer of ordinary skill.

A desirable structure for the accelerometer 46 would be what is deemed to be a monolithic accelerometer signal conditioning, part No. ADXL50 manufactured by Analog Devices of Norwood, Mass. This type of accelerometer is commonly used in conjunction with airbags of roadway vehicles.

What is claimed is:

1. A gaming device to be located on a supporting surface to which a ball is to be propelled by a user and then rebounded proximate to the user, said gaming device comprising;

a ball return wall having a contact surface, said contact surface adapted to be located transverse to the supporting surface;

said wall including a plurality of sensors located in a spaced-apart manner, each said sensor located in a specific area, each said sensor adapted to be sensitive to the force of the impact of said ball when said specific area for said sensor is struck by said ball;

microprocessor means connected to said sensors, a said sensor to transmit a signal to said microprocessor means upon said specific area of said wall proximate said sensor being struck by the ball, said microprocessor means to utilize said signals from said sensors within a preprogrammed game and then display the results of said game on a scoreboard to be observed by the user; and each said sensor comprising an accelerometer, said accelerometer being mounted within a lens, a light being mounted in conjunction with said lens, said lens being fixedly mounted within said wall.

* * * * *